United States Patent [19]

Tracy

[11] Patent Number: 4,488,333

[45] Date of Patent: Dec. 18, 1984

[54] LASH DEVICE

[76] Inventor: Richard J. Tracy, 1002 Forest Dr., Elgin, Ill. 60120

[21] Appl. No.: 407,436

[22] Filed: Aug. 12, 1982

[51] Int. Cl.[3] ..... A41F 1/00

[52] U.S. Cl. ..... 24/140; 24/144; 24/145; 24/163 R; 248/499; 410/101; 410/110; 410/156

[58] Field of Search ..... 24/31 B, 90 TA, 115 R, 24/163 K, 184, 198, 199, 200, 201 HE, 225, 289, 290, 297, 182, 265 R, 265 CD, 163 R, 129 R, 129 D, 140, 144, 145; D2/405; 2/96, 109, 113, 265, 323, 338, 114; 410/101, 102, 106, 107, 108, 109, 110, 111, 112, 116, 156; 135/119, 120; 248/499, 505

[56] References Cited

U.S. PATENT DOCUMENTS

| | | | |
|---|---|---|---|
| 143,916 | 10/1873 | Maass | 24/90 TA |
| 2,063,886 | 12/1936 | Alexandre | 2/338 X |
| 2,605,721 | 8/1952 | Johnson et al. | 410/112 |
| 2,803,201 | 8/1957 | Johnson et al. | 410/106 |
| 3,367,286 | 2/1968 | Jantzen | 410/102 |
| 3,454,249 | 7/1969 | Geisinger | 410/101 X |
| 3,490,105 | 1/1970 | Sucher | 24/90 TA |
| 3,864,757 | 2/1975 | Hartigan | 2/114 |
| 4,091,744 | 5/1978 | Crissy et al. | 410/116 |

FOREIGN PATENT DOCUMENTS

| | | | |
|---|---|---|---|
| 2404573 | 6/1979 | France | 24/200 |

*Primary Examiner*—William E. Lyddane
*Assistant Examiner*—James R. Brittain

[57] ABSTRACT

A lash device constructed according to the present invention includes a stiff flexible plate adapted to be attached to a substrate in overlying engagement therewith. The plate has a strap restraining device, in the form of a cross bar, on the upper face thereof, and has an outwardly flared peripheral wiper edge defining a recessed surface area on the underside of the plate. An attaching area on the plate is adapted to be fixed to the substrate to attach the plate thereto with the recessed surface area disposed in overlying engagement with the substrate, thereby flexing the plate to press the wiper edge firmly against the substrate along a continuous line of engagement therewith.

4 Claims, 4 Drawing Figures

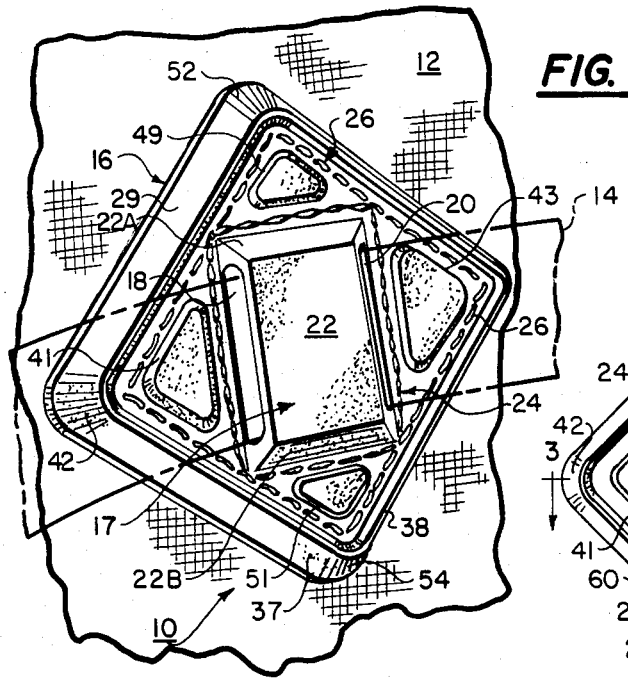
FIG. 1
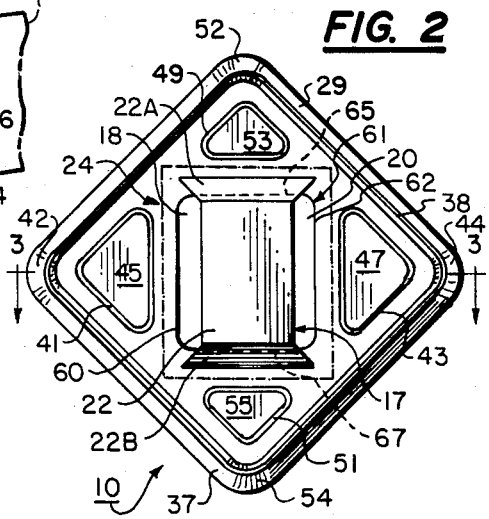
FIG. 2
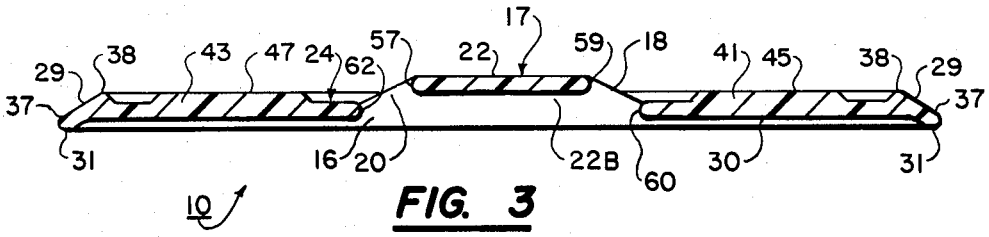
FIG. 3
FIG. 4
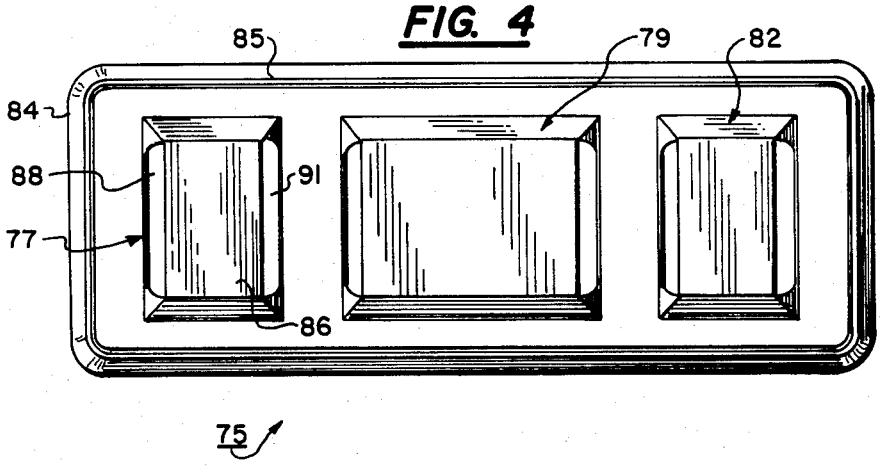

LASH DEVICE

DESCRIPTION

1. Technical Field

The present invention relates in general to a lash device, and it more particularly relates to a device for holding down a flexible strap to a substrate, such as a garment, a hand bag, tent, or the like.

2. Background Art

There have been different types and kinds of lash devices, or the like, adapted to be attached to a substrate, such as fabric material. For example, reference may be made to the following U.S. Pat. Nos.: 2,641,760; 2,808,973; 3,490,105; and 3,864,757.

Additionally, there have been lash devices, in the form of a flat patch, composed of leather material, sewn to a substrate, and provided with a pair of parallel spaced-apart elongated slots for receiving a strap threaded therethrough. The problem with such prior known lash devices is the eventual curling and lifting up of the marginal edges of the patch. Such curling up of the edges is unsightly, and results in the inadvertent snagging thereof, resulting in unwanted straining of the thread attaching the patch to the substrate. After repeated use, the thread becomes strained beyond its breaking point, thereby loosening the patch from the substrate and eventually causing it to be dislodged therefrom.

The exposed portions of the thread can also become abraded during the use of the device, when objects rub thereagainst. Such abrading also causes the eventual loosening and dislodging of the patch.

The threading of the strap through a pair of slots is an awkward manipulation, requiring some degree of manual dexterity. Also, once the strap is slipped through the slots, the strap frictionally rubs against the adjacent areas of engagement with the patch, thereby causing undesirable wear, and thus deterioration, of both the strap and the patch.

Therefore, it would be highly desirable to have a lash device, which can be conveniently fastened securely flat against the surface of a substrate, in such a manner that the edges of the device do not readily lift up and become snagged inadvertently. Also, such a device should be able to be attached to the substrate by sewing it in place, and the thread, used for attaching the device, should be protectable from unwanted abrading during use. Such a device should readily receive a strap, without any awkward or difficult manipulations, and the strap, once retained by the lash device, should not wear unnecessarily thereagainst. The lash device should also be relatively inexpensive to manufacture.

DISCLOSURE OF INVENTION

Therefore, it is the principal object of the present invention to provide a new and improved lash device, which can be conveniently attached securely flat against a substrate, and which can readily receive a strap for restraining purposes without the need for any awkward manipulations.

Another object of the present invention is to provide such a new and improved lash device, which can be sewn to a substrate, and which protects the thread from unwanted abrading.

A further object of the present invention is to provide such a new and improved lash device, which is relatively inexpensive to manufacture.

Briefly, the above and further objects of the present invention are realized by providing a new and improved lash device, which can be molded in one piece of thermoplastic material.

A lash device constructed according to the present invention includes a stiff flexible plate adapted to be attached to a substrate in overlying engagement therewith. The plate has a strap restraining device, in the form of a cross bar, on the upper face thereof, and has an outwardly flared peripheral wiper edge defining a recessed surface area on the underside of the plate. An attaching area on the plate is adapted to be fixed to the substrate to attach the plate thereto with the recessed surface area disposed in overlying engagement with the substrate, thereby flexing the plate to press the wiper edge firmly against the substrate along a continuous line of engagement therewith.

The wiper edge does not tend to lift up away from the substrate and become snagged during use, due to the flexing of the plate. The attaching area is adapted to be sewn through for fixing the plate to the substrate, and the plate includes projections extending above the surface of the attaching area to protect the thread from abrasion.

The cross bar has smoothly rounded side edges to facilitate the slipping of the strap thereunder. Also, the smooth edges protect the strap from unnecessary wearing thereaginst.

The lash device is preferably composed of a suitable thermoplastic material, which is durable, and which is flexible and compliant. The lash device is substantially thinner than conventional leather lash tabs, and thus is less bulky to use.

BRIEF DESCRIPTION OF DRAWINGS

The above-mentioned and other objects and features of this invention and the manner of attaining them will become apparent, and the invention itself will be best understood by reference to the following description of embodiments of the invention taken in conjunction with the accompanying drawings, wherein:

FIG. 1 is a pictorial view of a lash device, which is constructed in accordance with the present invention, and which is shown attached to a substrate;

FIG. 2 is a face view of the top surface of the device of FIG. 1;

FIG. 3 is a sectional view of the device of FIG. 2, taken substantially on line 3—3 thereof, the device being illustrated to a somewhat larger scale; and FIG. 4 is a face view of the top surface of another device, which is also constructed in accordance with the present invention, and which is provided with multiple strap restraining devices.

BEST MODE FOR CARRYING OUT THE INVENTION

Referring now to the drawings, and more particularly to FIGS. 1–3 thereof, there is shown a lash device 10, which is constructed in accordance with the present invention, and which is shown attached to a substrate 12 in FIG. 1 for holding down a strap, indicated in broken lines at 14 in FIG. 1. The substrate may be any suitable extraneous attachment surface, and can be a flexible fabric material, such as plastic or leather material, or the like. As will become apparent to those skilled in the art, the substrate 16 can also be a rigid surface.

The lash device generally comprises a stiff flexible plate 16, which is adapted to be attached in overlying engagement with the substrate 12, and which as generally indicated at 17 holds down the strap 14.

The restraining device 17 includes a pair of parallel spaced-apart elongated slots 18 and 20 on opposite sides of a raised cross bar 22. As shown in FIG. 1, the strap 14 can be threaded through the slots 18 and 20 and extend under the cross bar 22. In this regard, for example, the end portion (not shown) of the strap 14 is inserted into the slot 18 and then guided under the cross bar 22 and out the slot 20.

A generally planar attaching area 24 is in the form of a sewing area, and has the cross bar 22 disposed thereabove. As shown in FIG. 1, a thread 26 is sewn through the sewing area 24 of the plate 16 to fix it to the substrate. The plate 16 is sufficiently thin and pliable to permit it to be sewn to the substrate 12, by passing a sewing needle (not shown) repeatedly therethrough in a conventional manner, along a pattern as shown in phantom lines in FIG. 2.

An outwardly-flared generally square-shaped peripheral border tapered edge 29 extends along the underside of the plate at the marginal edge portion thereof. The edge 29 extends in the shape of a square, and defines a recessed surface 30 (FIG. 3) on the underside thereof. When the sewing area is attached to the substrate 12, as shown in the drawings, the plate 16 flexes into a shape such that the recessed underside surface 30 presses into overlying engagement with the substrate to, in turn, press a narrow bottom surface 31 (FIG. 3) of peripheral edge 29 firmly against, and into engagement with, the substrate 12 along a continuous line of engagement therewith. In this manner, the plate 16 at the edges thereof, does not tend to lift or curl up, and thus does not ordinarily become snagged inadvertently by objects (not shown), during use of the device 10.

In order to facilitate the ability of the device 10 to avoid becoming snagged on objects, the edge 29 has a downwardly outwardly sloping outer contoured surface 37, which tends to cam an object upwardly away from the plate 16. In this manner, the outer contoured surface 37 of the plate 16 provides it with a low profile, and one which is very difficult for an object to slip under and thus lift up.

The outer contoured surface 37 terminates at its upper end in a smoothly contoured raised border 38, which is disposed above the plane of the sewing area 24. Thus, the raised border 38 serves to help protect the exposed portions of the thread 26.

As a further aid in protecting the thread 26, a pair of similar large projections 41 and 43 having respective generally triangularly shaped flat land areas 45 and 47 are disposed between the centrally disposed cross bar 22 and the opposite rounded corners 42 and 44 of the plate 16. The projections 41 and 43 are generally triangularly shaped in cross section throughout their heights, and extend above the sewing area 24 to substantially the same height as the border 38.

Similarly, a pair of like small projections 49 and 51 having respective generally triangular shaped flat land areas 53 and 55 are positioned between the cross bar 22 and the oppositely-disposed respective rounded corners 52 and 54 of the plate 16. The projections 53 and 55 are substantially the same height as the height of the large projections 41 and 43 and the border 38. The small projections 53 and 55 are generally triangularly shaped throughout their heights, and extend above the sewing area 24 for helping protect the exposed portion of the thread 26.

The restraining device 17 is integrally connected to the plate 16 and includes a pair of upstanding end panels or members 22A and 22B, which are inclined toward one another and are integrally connected at their upper ends to the opposite ends of the cross bar 22. As best seen in FIG. 3, the bar 22 has a pair of smoothly rounded opposite side edges 57 and 59 to facilitate the slipping of the strap 14 through the elongated slots 18 and 20. The slots 18 and 20 are defined at one of the sides thereof by the respective smoothly rounded edges 60 and 62 and at the other sides thereof by the respective rounded edges 59 and 57 of the cross bar 22.

The smoothly rounded edges 57, 59, 60 and 62 greatly reduce wearing of the strap 14, when disposed in the slots 18 and 20.

The cross bar 22 extends in a direction between the corners 52 and 54, and is positioned over a generally rectangularly shaped opening 61 in the plate 16. The opening is defined by the parallel spaced-apart oppositely-disposed rounded edges 60 and 62 and the parallel spaced-apart oppositely-disposed edges shown in broken lines at 65 and 67 in FIG. 2.

The device 10 is composed of an integral one-piece configuration. The device 10 is composed of suitable elastomeric material, which is durable, flexible, and compliant. Its durability enables the cross bar to withstand substantial loading before fracturing. It is, therefore, able to be made of a substantially smaller thickness than the thickness of a leather lash device, thereby enabling the inventive device to be less bulky and somewhat lighter in weight. Since the device is compliant and flexible, it can readily be used on a flexible substrate.

Referring now to FIG. 4, there is shown a multiple retainer lash device 75, which is also constructed in accordance with the present invention. The device 75 is generally similar to the device 10, except that the device 75 includes three restraining devices generally indicated at 77, 79 and 82 for holding down a strap, such as the 14 of FIG. 1, threaded therethrough. The restraining devices 77, 79 and 82 are generally similar to the restraining device 17 of FIG. 1.

The device 75 includes an elongated, generally-rectangular plate 84, similar to the plate 16 of FIG. 1. The plate 85 has a raised border 84, similar to the raised border 38, and has a similar underside.

The restraining devices are arranged in a row, and the outer devices 77 and 82 are of a similar size, the centrally-disposed device 79 being substantially wider than the other two restraining devices.

The three restraining devices 77, 79 and 82 are similar to one another and to the restraining device 17. Since the restraining devices are similar to one another, only the restraining device 77 will now be described. The device 77 includes a raised cross bar 86, similar to the bar 22. A pair of parallel, oppositely-disposed elongated slots 88 and 91 are similar to the respective slots 18 and 20 of FIG. 1, and serve the same purpose.

The device 75 is preferably composed of the same material as the device 10.

While particular embodiments of the present invention have been disclosed, it is to be understood that various different modifications are possible and are contemplated within the true spirit and scope of the appended claims. For example, different shapes of plates are contemplated, such shapes including circular and oval shapes. There is no intention, therefore, of limitations to the exact abstract or disclosure herein presented.

I claim:

1. A lash device adapted to restrain a strap, or the like, to a substrate, comprising:

a thin stiff flexible plate adapted to be attached to the substrate in overlying engagement therewith;

said plate having means for restraining the strap;

said plate having an outwardly flared peripheral tapered edge means being disposed at the underside of said plate and defining a recessed surface area on said underside, said edge means having a narrow bottom surface adapted to engage the substrate;

said plate having an attaching area adapted to be fixed to the substrate to attach said plate thereto and thereby to flex said plate to cause said recessed underside surface to be pressed into overlying engagement with the substrate and thereby to press said narrow bottom surface of said peripheral edge means firmly against the substrate along a substantially continouous line of engagement therewith to help prevent said edge means from lifting or curling away from the substrate and becoming snagged during use; wherein said tapered edge means slopes downwardly outwardly away from said attaching area, and has an outer contoured surface for camming an object away from said plate to help prevent such an object from lifting inadvertently the plate away from the substrate;

an upstanding raised border disposed above the plane of said attaching area for thread protecting purposes; and wherein said device is composed of a thermoplastic elastomeric material, and is of an integral one-piece construction.

2. A lash device acocrding to claim 1, wherein said attaching area is an imperforate sewing area adapted to be sewn through to the substrate.

3. A lash device according to claim 2, further including a plurality of upstanding projections extending upwardly from said attaching area for thread protecting purposes.

4. A lash device according to claim 1, further including at least one additional similar means for restraining the strap.

* * * * *

UNITED STATES PATENT AND TRADEMARK OFFICE

CERTIFICATE OF CORRECTION

PATENT NO. : 4,488,333

DATED : 18 December 1984

INVENTOR(S) : Richard J. Tracy

It is certified that error appears in the above-identified patent and that said Letters Patent is hereby corrected as shown below:

Column 4, line 49, delete "85" and substitute --84-- therefor.

Column 4, line 49, delete "84" and substitute --85-- therefor.

Signed and Sealed this

*Sixteenth* Day of *July 1985*

[SEAL]

*Attest:*

DONALD J. QUIGG

*Attesting Officer* *Acting Commissioner of Patents and Trademarks*